United States Patent [19]

Hammond et al.

[11] Patent Number: 4,659,892

[45] Date of Patent: Apr. 21, 1987

[54] VALVE SEAT INDUCTION HEATING APPARATUS

[75] Inventors: Michael R. Hammond, Clawson, Mich.; Robert V. Vickers, Chagrin Falls, Ohio

[73] Assignee: Tocco, Inc., Boaz, Ala.

[21] Appl. No.: 759,249

[22] Filed: Jul. 26, 1985

[51] Int. Cl.[4] ..... H05B 6/14

[52] U.S. Cl. ..... 219/10.57; 219/10.43; 219/10.71; 219/10.75; 29/564; 414/744 R; 901/7

[58] Field of Search ..... 219/10.57, 10.41, 10.43, 219/10.69, 10.71, 10.75, 388; 266/129; 29/564, 563; 901/7, 41; 414/744 R

[56] References Cited

U.S. PATENT DOCUMENTS

| | | | |
|---|---|---|---|
| Re. 29,046 | 11/1976 | Del Paggio | 219/10.57 |
| 3,543,392 | 12/1970 | Perry et al. | 29/564 X |
| 3,576,540 | 4/1971 | Fair et al. | 29/563 |
| 3,967,089 | 6/1976 | Seulen et al. | 219/10.79 X |
| 3,988,179 | 10/1976 | Del Paggio et al. | 219/10.57 X |
| 4,237,598 | 12/1980 | Williamson | 29/564 X |
| 4,454,645 | 6/1984 | Schissler | 29/564 X |
| 4,585,916 | 4/1986 | Rich | 219/10.71 X |

*Primary Examiner*—Philip H. Leung

*Attorney, Agent, or Firm*—Body, Vickers & Daniels

[57] ABSTRACT

An induction heating apparatus for inductively heating the valve seats of a family of engine component designs includes a plurality of rotatably mounted inductors which are selectively indexed and cycled in accordance with the component design presented at the heat treating station.

19 Claims, 12 Drawing Figures

VALVE SEAT INDUCTION HEATING APPARATUS

BACKGROUND

The present invention relates to the art of induction heating and more particularly to a method and apparatus for inductively heating the valve seats of a family of engine component configurations.

The invention is particularly applicable for heating the exhaust valve seats of internal combustion engine heads of varying configurations and will be described with reference thereto; however, it should be appreciated that the invention has broader aspects and may be used for heating a plurality of discretely spaced areas of a grouping of workpiece designs.

With the switch from leaded to unleaded gasoline, the lubricating properties of the lead compounds were removed and it was found that the exhaust seats of the engine heads were subject to increased wear at the elevated engine temperatures. To counteract the wear, it has become commonplace to inductively heat and quench harden the exhaust valve seats. Such heat treating is well suited for the automated processing required for efficient motor vehicle production. Accuracy and uniform magnetic coupling between the inductor and the valve seats are also necessary machine capabilities to provide hardness uniformity on an automated basis. It has been demonstrated that an apparatus as disclosed in U.S. Pat. No. Re. 29,046 is particularly well suited for high speed, uniform heat treating of engine valve seats. Therein, the apparatus is effective for simultaneously heating the valve seat in a single operation. This is achieved by mounting a plurality of independently reciprocable spring biased inductors on a common movable frame. At the heat treating station, the frame is moved toward the head until all the individual inductors engage the associated valve seat. The inductor coils are free to radially float with respect to the frame to compensate for manufacturing variations and are mechanically centered coaxially with the valve seat. After contacting the seats, the inductors are locked with respect to the frame, the frame is retracted a predetermined axial distance to establish a uniform magnetic coupling and the inductor coil energized to inductively heat the seats. Thus, high speed uniform heat treating is provided with dependable, non-complicated equipment.

Such an apparatus however, is basically dedicated to a single engine design, because of the design to design variations in valve seat number, spacing, orientation, size, hardness and other design parameters. While the unit could be adapted for processing other configurations, a substantial changeover time and expense is required to remove the inductors, with associated electrical, hydraulic and coolant connections, and to install inductors adapted for another configuration. In order to justify such a conversion, large volume production runs are required for each engine design. This has the effect of increasing the inventory of processed heads. Recently, the engine manufacturers have sought to reduce their inventories and obtain parts on an as required basis for all their engine requirements. Although this can be achieved by having dedicated machines, this can lead to under utilization of machines, particularly with regard to the lower volume designs.

SUMMARY OF THE INVENTION

The present invention retains the aforementioned advantages of the existing systems while providing an apparatus capable of continuously processing a random array of head configurations arriving at the heat treating station. Individual banks of inductor assemblies which may be selectively indexed in accordance with the engine head design presented at the heat treating station. Each inductor assembly is self-contained, requiring only coupling to the primary power supply. Each is provided with lockable, self aligning inductors reciprocably mounted on a common frame and tailored to the design to be processed. Utilities for the positioning, cooling and quenching functions are provided for each inductor assembly. The inductor assemblies are located circumferentially around a rotatable turntable which may be vertically or horizontally disposed. As determined by a sensing unit upstream of the heat treating station, the engine design is identified and the appropriate inductor assembly indexed into position. Thereafter, the assembly is shifted to couple the inductors to the power supply at a telescoping inductive transformer. The entire unit is then reciprocated toward the head until all the inductors are seated, the inductors thereafter locked to their common frame which is then withdrawn to establish a uniform magnetic coupling and the inductors appropriately energized to inductively heat the seats. The seats may then be directly quenched through inductor applied coolant or mass quenched by the head material. The assembly is then uncoupled and returned to the indexing position to repeat the processing function if the head design is repeated or to be rotated for the indexing of the required inductors for the next design. In this manner, full machine utilization can be achieved on a single conveyor line routing an array of engine head designs.

Accordingly, the primary object of the present invention is the provision of a single induction heating apparatus capable of heat treating varying workpiece designs on an as presented basis.

Another object is the provision of an induction heating apparatus wherein a plurality of inductors adapted to inductively heat randomly arriving engine valve seats are selectively automatically coupled to a main power supply.

A further object of the invention is the provision of an induction heating apparatus which identifies the workpiece design arriving at a workstation, selects from an array of inductor assemblies the appropriate assembly for the arriving workpiece and indexes the assembly to the station, automatically effects a coupling with a central power supply and sequences the inductors through a heating cycle.

Still another object of the invention is the provision of an apparatus for inductively heat treating valve seats for varying engine heat designs utilizing automatically positioned inductor assemblies carrying self-contained utilities and operable by a single central power supply.

BRIEF DESCRIPTION OF THE DRAWINGS

These and other objects and advantages of the present invention will be apparent from the following description taken in conjunction with the accompanying drawings in which.

DETAILED DESCRIPTION OF THE PREFERRED EMBODIMENT

Figure 1:
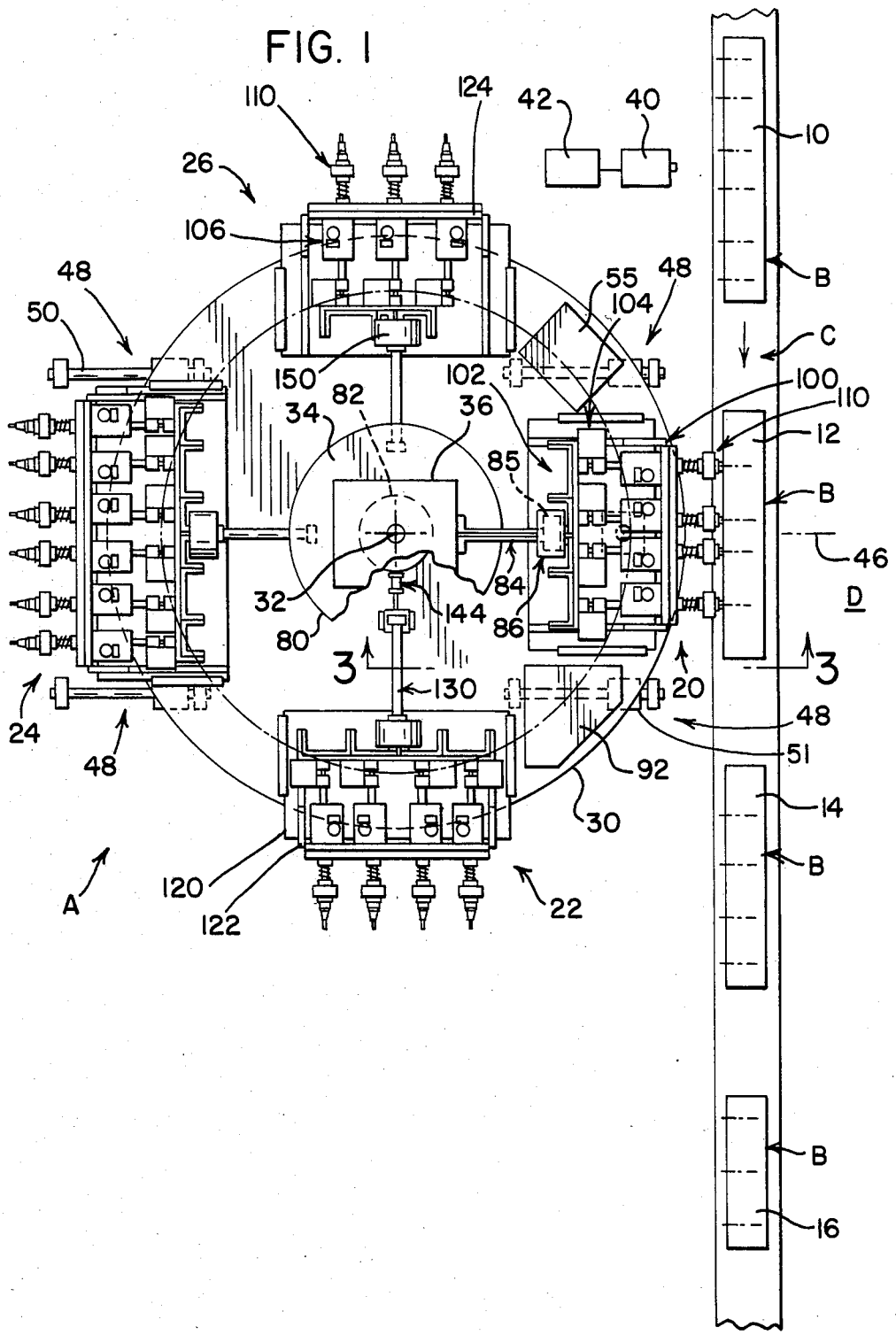
FIG. 1 is a top plan view of one embodiment of an induction heating apparatus with one of the inductor assemblies in the operative position with respect to an engine component travelling along a conveyor line.
Figure 2:
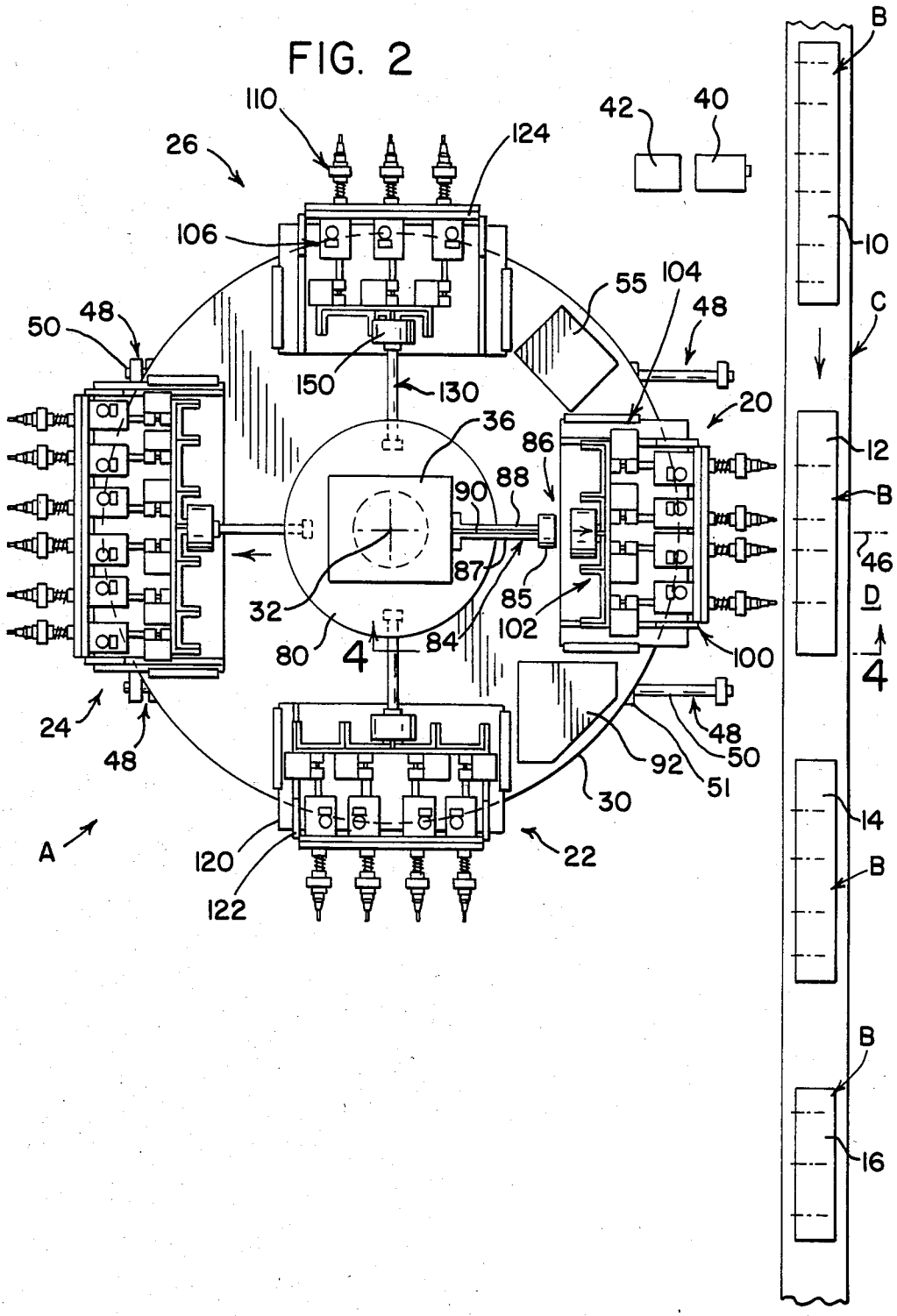
FIG. 2 is a view similar to FIG. 1 showing the induction heating apparatus in the transfer position.

Referring to the drawings wherein the showings are for the purposes of illustrating the preferred embodiment and not for limiting the same, FIGS. 1 and 2 show an induction heating apparatus A which is operable as hereinafter described for heating the conical valve seats of an array of engine components B travelling along a longitudinal horizontal conveyor line C. The engine components, as illustrated, comprise a plurality of configurations 10, 12, 14, 16 which differ in valve seat size, location, number, heat treatment and other parameters dependent on the engine with which they are associated. The component designs may arrive in random order at a heat treating station D adjacent the heat treating apparatus A, and are so illustrated for purpose of this description. However, in actual practice, the components may arrive in production runs of varying lengths depending on the production requirements of the engine manufacturer.

Each component B is conventionally carried on the conveyor line C by a fixture, not shown, which accurately orients and mutually spaces the components therealong. The conveyor line C is operated in a well known manner to shuttle each component to the heat treating station D for a time interval sufficient to accommodate the heat treating operations hereinafter described.

The heat treating apparatus A generally comprises four inductor assemblies 20, 22, 24 and 26 mounted on a turntable 30 which is rotatable about a vertical axis 32 with respect to a platform 34 on which a power supply 36 is centrally mounted. The inductor assembly 20 is adapted to heat treat the valve seats of component 12, the assembly 22 the valve seats of component 14, the assembly 24 the valve seats of component 10, and the assembly 26 the valve seats of component 16. The identification of the particular engine component to be processed at the heat treating station D is identified by a sensor 40 operatively associated with a control unit 42 which is coupled to the control units of the inductive heating apparatus A for identifying the component design, indexing the proper inductor assembly adjacent the heat treating station D and carrying out the various functions for performing the heat treating processing thereon. In this manner, the entire array of the components can be processed on a single apparatus notwithstanding the random arrival of component configurations at the heat treating station.

Turntable and Platform

The turntable 30 and the platform 34 are operative to index the appropriate inductor assembly at the heat treating station for the heat treating of an engine component design arriving thereat and to establish the electrical coupling with the power supply 36 whereafter the heat treating sequence is effected by the control functions associated with the indexed inductor assembly.

Figure 3:
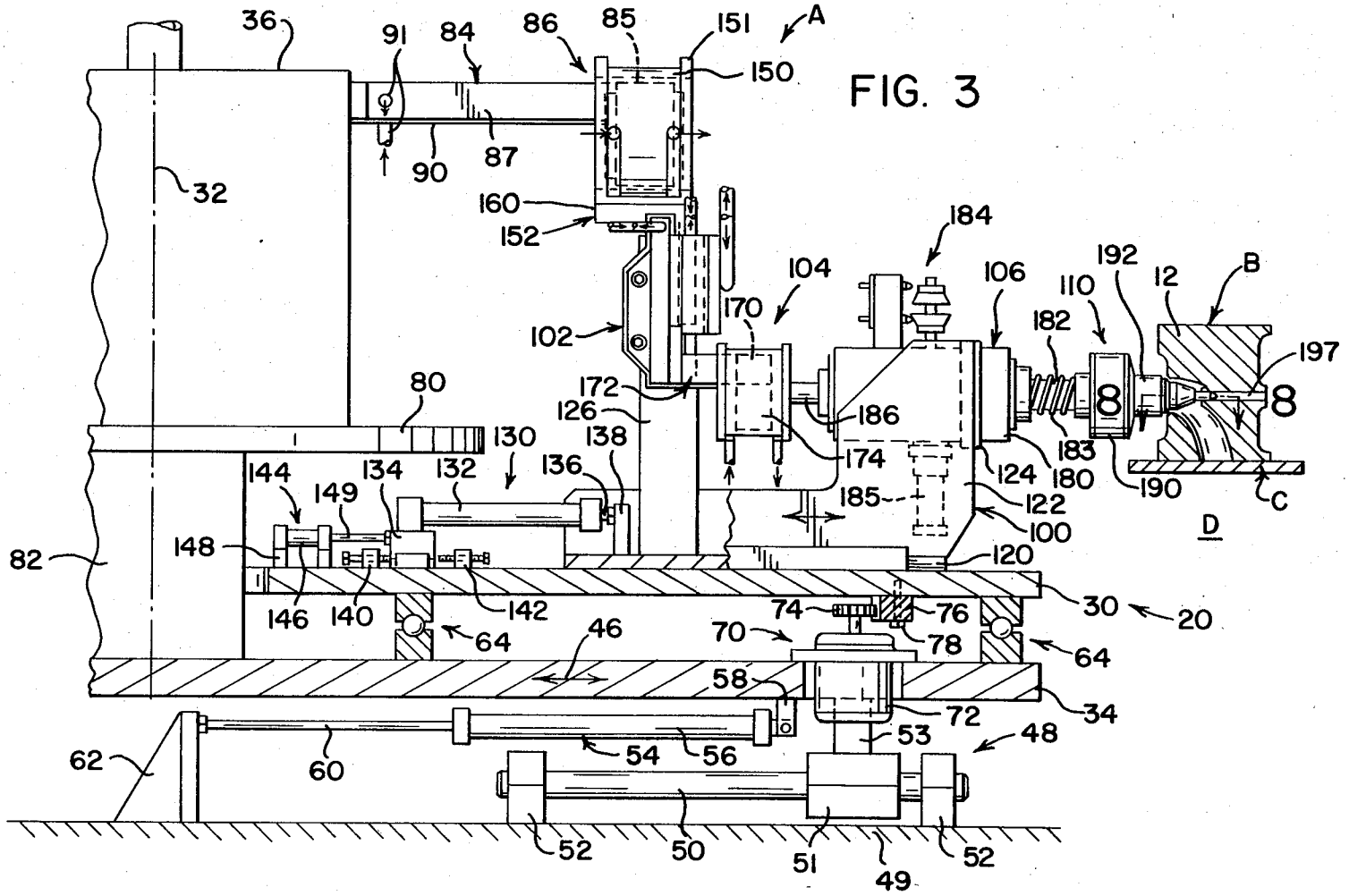
FIG. 3 is an enlarged partial side elevational view showing the inductor assembly in the operative position.
Figure 4:
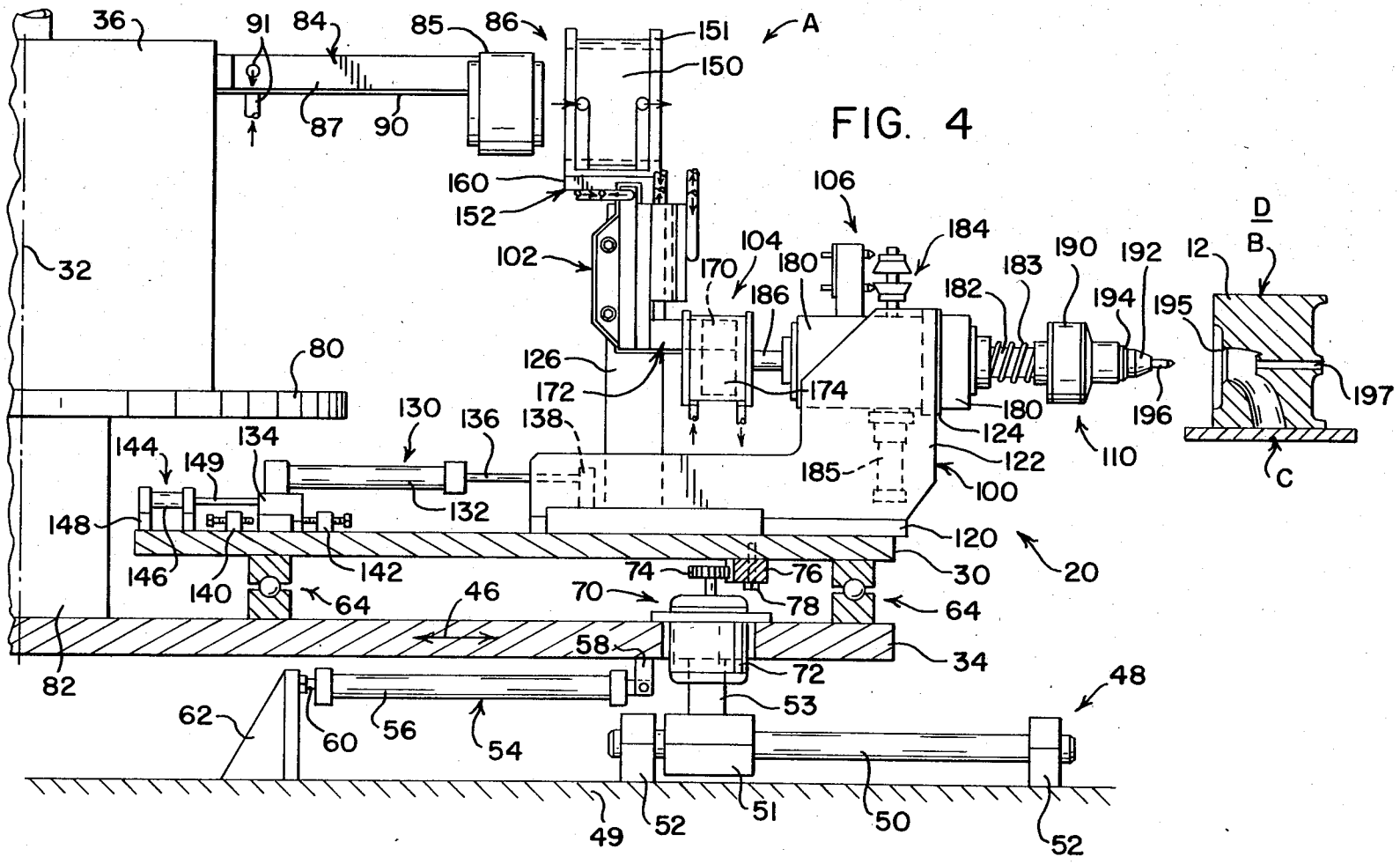
FIG. 4 is a view similar to FIG. 3 showing the inductor in the transfer position.
Figure 5:
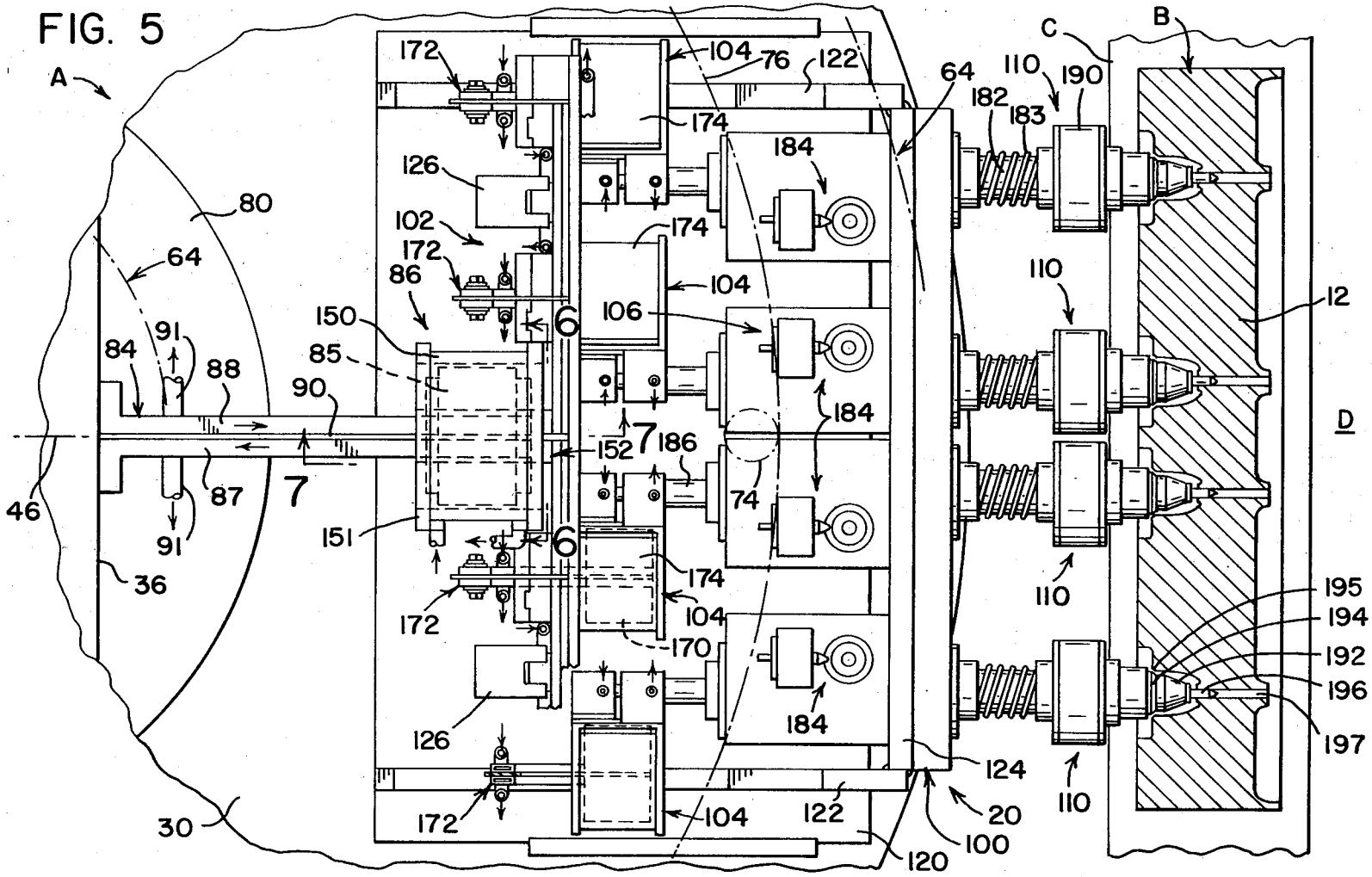
FIG. 5 is an enlarged partial plan view of one of inductor assemblies in operative position with respect to the engine component.

Referring to FIGS. 1–4, the platform 34 is generally circular and of the same diameter as the turntable 30. The platform 34 is supported for reciprocation along a horizontal, longitudinal axis 46 perpendicular to the heat treating station D by four slide assemblies 48 fixed to the foundation 49. Each slide assembly, as shown in FIGS. 3 and 4, includes an elongated shaft 50 and a sleeve 51. The shaft 50 is supported at the ends thereof to spaced support blocks 52 secured to the foundation 49. The shaft 50 is telescopically received in a central bore in the sleeve 51. The sleeve 51 is fixedly connected to the bottom surface of the platform 34 by arm 53. A fluid actuator 54, connected to a pneumatic or hydraulic supply 55 carried by the turntable 30, includes a cylinder 56 pivotally connected by a bracket 58 to the lower surface of the platform 34. The end of the output shaft 60 from the cylinder 56 of the actuator 54 is connected to an abutment 62 on the foundation 49. In the retracted or transfer position shown in FIG. 4, the turntable 30 may be rotated about axis 32 to present the desired inductor assembly to the heat treating station D. In the extended operative or heat treating position shown in FIG. 3, the actuator 54 is effective for establishing the positioning of the inductor assembly, representatively shown as assembly 20, in the heat treating position. The actuator 54 is operated by the control unit 42 in a conventional manner to achieve the hereinafter sequenced operations.

The turntable 30 is an annular plate which is rotatably supported on the platform 34 by a plurality of bearing assemblies 64 for rotation about the vertical axis 32. The turntable 30 is selectively driven about the axis 32 by means of a drive unit 70 comprising an electric motor 72 carried by the platform 34 and having a pinion 74 which engages the teeth of a circular ring gear 76 fixedly connected to the underside of the turntable 30 by fasteners 78. The motor 72 is conventionally selectively actuated by the control unit 42 to drive the turntable 30 to properly position the appropriate inductor assembly at the heat treating station D. The drive unit 70 may take any alternative form for achieving the aforementioned sequenced rotation.

The Power Supply

The power supply 36 is a high frequency electrical unit of a type well known for the induction heat treating of valve seats and does not form a part of the present invention. The power supply 36 is mounted on a plate 80 which is fixedly supported above the turntable 30 by a base 82 connected to the platform 34 generally symmetrically with the vertical axis 32 and the horizontal axis 46.

Figure 6:
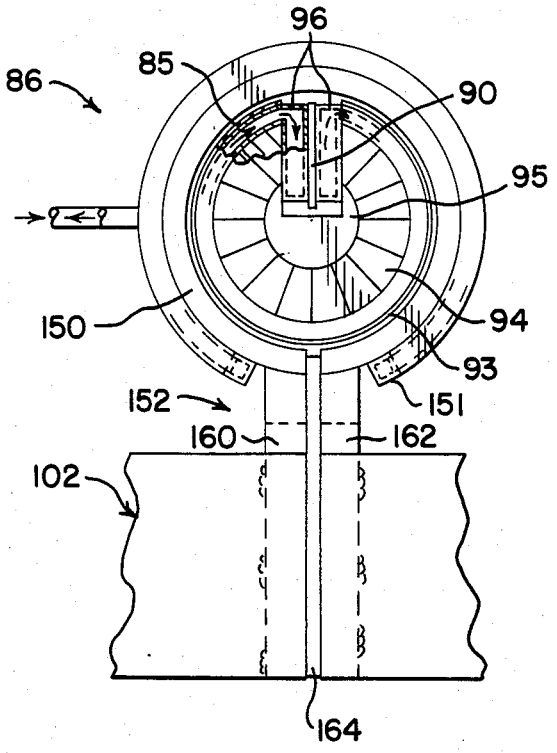
FIG. 6 is an enlarged cross sectional view taken along line 6—6 in FIG. 5.
Figure 7:
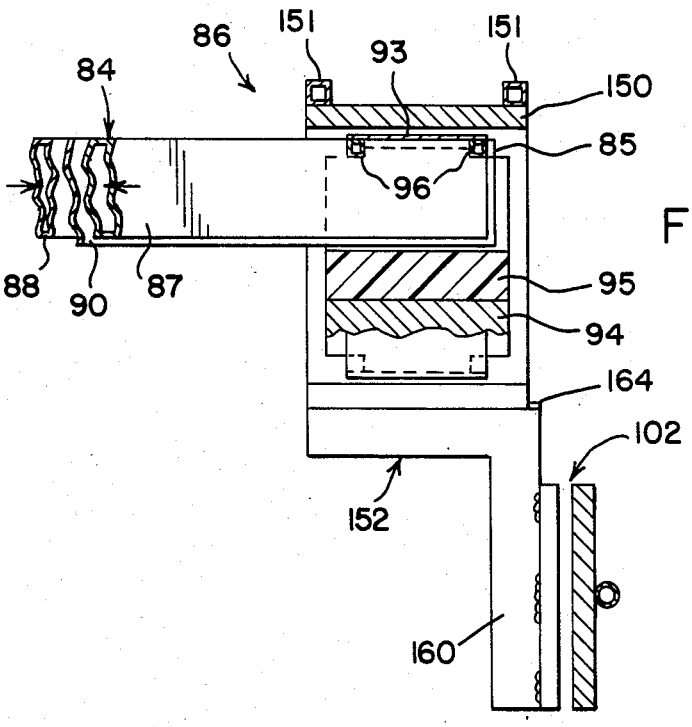
FIG. 7 is an enlarged cross sectional view taken along line 7—7 in FIG. 5.

The power supply 36 includes a primary lead assembly 84 connected to the output thereof which projects radially outwardly generally in a vertical plane through the horizontal axis 46. The primary lead assembly 84 terminates at the primary winding 85 of a primary inductor transformer 86. The lead assembly 84 includes a first lead 87 connected to one output terminal of the power supply and a second lead 88 conducted to the other output terminal of the power supply. The leads 87 and 88 are mutually separated by an insulating laminate 90. In a conventional manner, the leads 87 and 88 are of a hollow rectangular construction, the interior passage thereof being supplied with a coolant through coolant lines 91 connected to a cooling system 92 carried on the turntable 30 for maintaining the operating temperature thereof within prescribed limits. Referring to FIGS. 6 and 7, the primary winding 85 has a C-shaped body including an electrically conductive outer sheet 93, a conductive outer shell 94 and an insulating core 95. The winding 85 includes a vertical slot at which the terminal portion of the leads 87 and 88 are attached. Coolant tubes 96 communicate with the coolant passages in the leads 87 and 88 to provide for temperature control thereof. The axis of the primary winding is horizontal and lies in a common vertical plane with the axis 46. The primary winding 85 is thus in fixed relationship with respect to the platform 34.

Inductor Assemblies and Related Structure

Referring to FIGS. 1–4, the inductor assemblies 20, 22, 24 and 26 are uniformly circumferentially spaced about the periphery of the turntable 30. As representatively illustrated by inductor assembly 20, each comprises a carrier frame 100, a bus bar assembly 102, a secondary inductor transformer 104 and an inductor support and locking device 106 telescopically carrying an inductor device 110.

With the exceptions hereinafter noted, the inductor assemblies may preferably take substantially form disclosed in U.S. Pat. No. Re. 29,046 which is hereby incorporated by reference. Accordingly, the structure will be described with reference to the major structural components and their associated unit functions.

The carrier frame 100 includes a generally rectangular base 120 supported on the turntable 30. By appropriate guide means, the base 120 is guided for reciprocation parallel to the transverse axis 46 between the extended operative position shown in FIG. 3 and the retracted transfer position shown in FIG. 4. The carrier frame 100 further includes generally two parallel L-shaped side plates 122 connected at a lower portion to the sides of the base 120 and connected to a horizontal frame 124 at the upper frontal portion thereof. The frame 124 is suitably appertured to provide, with associated structure, for the mounting of the inductor support and locking devices 106. The bus bar assembly 102 is fixedly supported on the base 120 by support structure 126. A primary actuator 130 is effective for coupling the windings of the primary transformer 86. The primary actuator 130 which may be hydraulic or pneumatic comprises a cylinder 132 fixedly connected to a support block 134 slidably supported on the turntable 30 and an output shaft 136 connected at its outer end to a support plate 138 fixedly connected to the base 120. The actuator 130 is fluidly connected to the fluid source 55 by lines, not shown. The movement of the block 134 is guided by a tongue and groove joint, for movement between a retracted position as shown in FIG. 3 and an extended position as shown in FIG. 4. The limit of movement of the block 134 is determined by adjustable stops 140 and 142. The block 134 is shifted between the limits of the stops 140 and 142 by means of a hydraulic or pneumatic secondary actuator 144. The secondary actuator 144 includes a cylinder 146 fixedly connected to the inner periphery of the turntable 30 by brackets 148 and an output shaft 149 connected to the block 134. The secondary actuator 144 is thus effective to shift the block 134 betewen the retracted position shown in FIG. 3 and the extended position shown in FIG. 4 to thereby accurately space the inductor device with respect to the engine component subsequent to the coupling and location operations hereinafter described.

As shown in FIGS. 4–7, the bus bar assembly 102 fixedly supports the secondary winding 150 of the primary inductor transformer 86 by means of a secondary lead assembly 152. The secondary winding 150 is a cylindrical body having a C-shaped cross section and formed of an electrically conductive sheet. The secondary winding 150 may have a hollow cross section for communicating in a coolant loop with eletctrical components carried on each inductor assembly through coolant lines 151 connected to the coolant source 92. The inner cylindrical surface of the secondary winding 150 has a predetermined clearance fit with respect to the outer cylindrical surface of the primary winding 85 to establish an optimum magnetic coupling therebetween. The secondary winding 150 is supported coaxially with the primary winding 85 to provide for a telescopic reception thereover. The secondary winding 150 additionally includes a longitudinal slot which is opposed to the slot in the primary winding 85. The secondary lead assembly 152 includes a first lead 160 connected to the outer surface of the winding 15 adjacent one side of the slot and a second lead 162 connected to the outer surface of the winding 150 adjacent the other side of the slot. The leads 160 and 162 are mutually separated in a well known manner by an insulating laminate 164. The outer ends of the leads 160, 162 are electrically and mechanically connected to the associated network of the bus bar assembly 102 for establishing the requisite electrical circuit for the secondary inductor transformer 104.

The secondary inductor transformer 104 includes a primary winding 170 electrically connected to and supported on the bus bar assembly 102 by lead assembly 172, and a secondary winding 174 electrically connected to and supported by the support and locking device 106, all preferably in accordance with the comparable components described in the aforementioned U.S. Pat. No. Re. 29,046. The secondary winding 150 is telescoped into operative relationship with the primary winding 85 as shown in FIG. 3 from the position shown in FIG. 4 by means of the primary actuator 130. At the transfer position, the winding 85 is axially spaced from the secondary winding 150 while in the operative position in FIG. 3, the windings are in telescopically coupled relationship.

Figure 8:
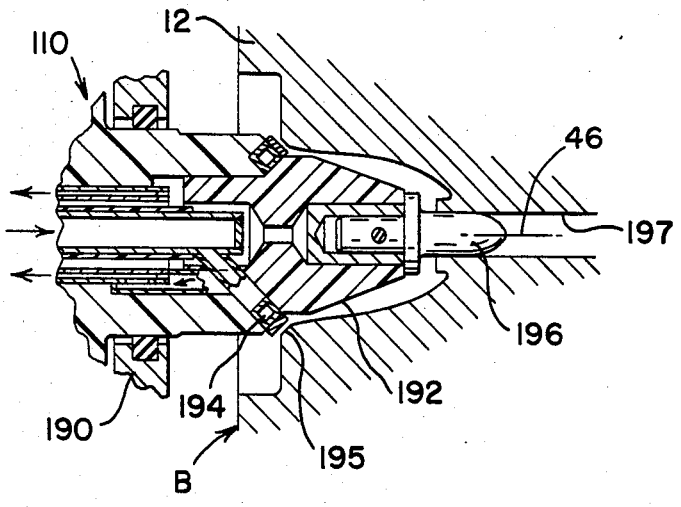
FIG. 8 is an enlarged partially sectioned view of the inductor device with the inductor coil in the inductive heating position with respect to the valve seat of the engine component.
Figure 9:
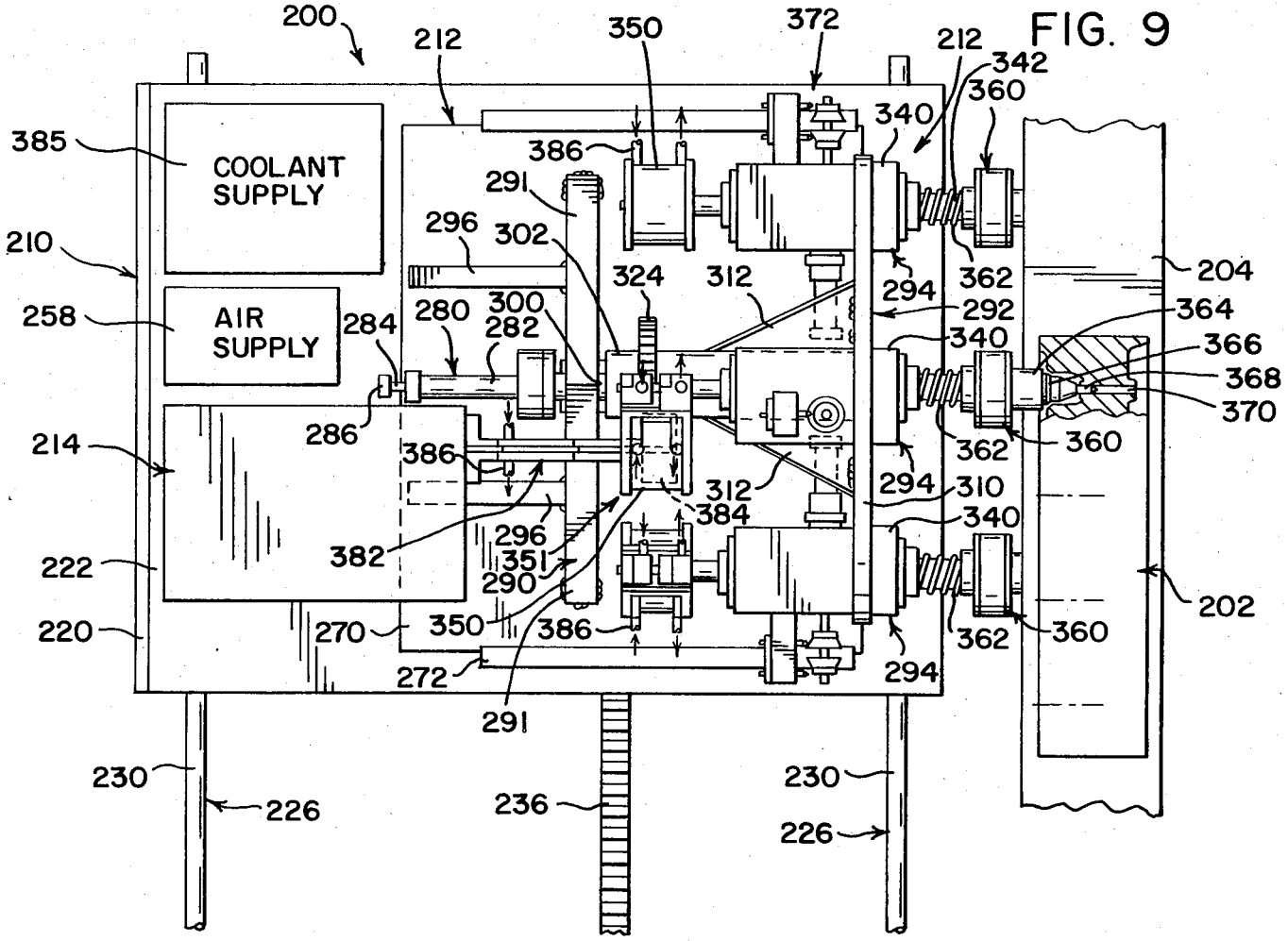
FIG. 9 is a top plan view of another embodiment according to the present invention with one of the inductor assemblies in the operative position with respect to an engine component travelling along a conveyor line.

Each inductor support and locking assembly 106 comprises a cylindrical housing 180 supported on the frame 124. A support sleeve 182 slidably supported by the housing 180 and carrying the inductor device 110 at the outer end thereof is biased to an outward position by a compression spring 183. The position of the sleeve 182 relative to the housing 180 is controlled by a locking unit 184 which is selectively actuated by hydraulic actuator 185 to clamp the sleeve 182 after the inductor device 110 engages the valve seat of the engine component B. The inner end 186 of the sleeve 182 is connected to the secondary winding 174. Each inductor device 110 includes a housing 190 which carries an insert 192 for movement in a radial plane with respect to the longitudinal axis 46. As shown in FIG. 8, the insert 192 carries an inductor coil 194 having an outer conical surface which matches the conical surface of the valve seat 195 of the engine component 12. The insert 192 outwardly terminates with the cylindrical rounded nose 196 which is adapted to slidably register with the valve stem bore 197 which is coaxial with the valve seat 195. Accordingly, the inductor device 110 allows the insert 192 and the inductor coil 194 to radially float relative to the sleeve 182 to obtain coaxial alignment. In a well known manner, the inductor coil 194 includes two leads which are respectively connected internally with the secondary winding 174 and through which the inductor coil 194 is energized in accordance with operation of the power supply 36.

Operation of the Induction Heating Unit

With reference to the illustrations, the induction heating apparatus A is operated in accordance with information supplied by the sensor 40 as to the configuration of an engine component passing a predetermined location on the conveyor line C. As illustrated, the sensor 40 is positioned to determine the configuration of the engine component immediately preceeding the component at the heat treating station D. However, the sensor 40 may be located at any appropriate place along the conveyor line C and through the sequencing of a microprocessor in the control unit 42 schedule the indexing of the turntable 30 to locate the desired inductor assembly at the heat treating station for carrying out the processing of the design thereat. More particularly, the sensor 40 has previously determined that configuration B will be next located at the heat treating station. Accordingly, after completion of the heat treating operation on component 14, the associated inductor assembly 22 will have been withdrawn by actuator 54 to space the inductor device 110 from the component 14. Concurrently or sequentially thereto, the actuator 130 is extended to uncouple the secondary winding 150 from the primary winding 85 of the inductor transformer 86. Thus, as representatively illustrated in FIG. 4, the inductor assembly is at the transfer position. The drive unit 70 is then actuated to rotate the turntable 30 with respect to the platform 34 thereby rotating the inductor assembly 22 to the illustrated position of FIGS. 1 and 2, and concurrently locating inductor assembly 20 at the illustrated righthand position as shown in FIG. 2. With the inductor devices 110 and the inductor assembly 20 roughly axially aligned with respect to the component 12, the actuator 130 is energized and retracts the output shaft 136 and shifts the base 120 toward the block 134 thereby establishing the electrically coupled relationship for the primary inductor transformer 86 as shown in FIG. 3. Next, the primary actuator 54 is activated to extend the shaft 60, thereby moving the platform 34 horizontally outwardly, along the axis 46 and carrying therewith the inductor assembly 20. As the nose 196 enters the valve stem bore 197, the insert 192 and the coil 194 are mechanically aligned with the valve seat 195 and the device 110 accommodates any radial variation between the insert 192 and the sleeve 182. The actuator 54 will continue outward movement until all the inductor coils 194 are physically engaged with their associated valve seats 195 against the biasing of the springs 183. The actuator 54 is then deenergized and the locking device 184 actuated to fixedly clamp the inductor devices 110 and the sleeves 182 with respect to the housings 180. The secondary actuator 144 is then energized to shift the block 134 rearwardly from stop 142 to stop 140. This withdraws the inductor coils 194 a predetermined distance from the valve seats 195 to establish the desired inductive coupling spacing. The power supply 36 is then energized at the appropriate level for achieving the desired inductive heating of the valve seats of the component 12 through the lead assembly 84, the primary transformer 86, the bus bar assembly 102, the secondary inductor transformers 104, the interal circuitry of the devices 110 and thereby the coils 194. This will inductively heat the valve seat areas to the predetermined elevated temperature. At this point, the power supply 36 is deenergized. The quenching rate for achieving the desired valve seat hardness may either be effected by the quenching provided by the material mass surrounding the valve seats or in a well known manner the inductor device 110 may be provided with quenching jets connected to a coolant source for supplying liquid media directly onto the heated valve surface. Subsequent to the heating operation, the actuators are reversely sequenced. Preferably, the actuators 54 and 130 are cojointly actuated to leftwardly shift the platform 34 while rightwardly shifting the inductor assembly 20 such that at completion of the cycle, the components assume the transfer position shown in FIG. 4. In the event the next presented component design is also of the same configuration, the indexing of the inductor assembly does not occur and the unit heat treating operations are repeated as described above. However, should a different component design be next presented to the heat treating station D, as for example configuration 10, the turntable will be rotated 180° to thereby index inductor assembly 24 adjacent the component 10 at the heat treating station. The heat treating operations will then be carried out by the assembly 24 in the aforementioned manner.

While the above apparatus has been described with reference to a rotatable indexing for the inductor device, it should be apparent that other transfer mechanisms may be used to shuttle the appropriate inductor assembly into indexed relationship with the presented component at the heat treating station for coupling with a single power supply and operation of the control systems for carrying out the desired heat treating operations. Similarly, more than four assemblies may be provided on the turntable or the inductors may be moved in pallet fashion to and from the turntable by supplemental equipment while still carrying out the basic operations and with the advantages hereinabove described.

A further embodiment of the present invention is shown in FIGS. 9 through 12. Therein, an induction heating apparatus 200 is effective for heat treating an array of engine components 202 travelling on an elevated horizontal conveyor line 204. As in the preceding embodiment, the engine components 202 are presented to the apparatus 200 in a random array of designs, each having valve seats differing in number, orientation, spacing and hardness requirements. The heat treating apparatus 200 is adapted to heat treat the valve seats of the presented component on an as presented basis under the control of a sensor and control unit as described above.

More particularly, the apparatus 200 comprises a translatable base assembly 210, a rotatable inductor assembly 212 and a power supply 214.

The base assembly 210 includes a lower base plate 220 and an upper support plate 222. The base plate 220 is slidably supported relative to the foundation 224 by a pair of slide assemblies 226. Each slide assembly 226 includes a pair of groove blocks 228 at the corners of the plate 220 which are slidably connected to an elongated rail 230. The rails 230 extend parallel to the conveyor line 204 and are fixedly supported on the foundation 224. A drive motor 232 fixedly connected to the lower surface of the plate 220 has an output pinion 234 which drivingly engages an elongated rack 236 fixedly connected to the foundation 224. The rack 236 also extends parallel to the rails 230 and the conveyor line 204. Upon actuation of the motor 232, the pinion 234 is operative to traverse therack 236 and in turn bidirectionally drive the base plate 220 along the rails 230 as guided by the blocks 228.

The upper support plate 222 is slidably supported on the base plate 220 by slide assemblies 238. Each slide assembly 238 comprises bushings 240 attached to the lower surface of the support plate 222 and a guide bar 242 mounted on the top surface of base plate 220 by blocks 246. The guide bars 242 are laterally spaced and extend transversely perpendicular to the rails 230 and the conveyor line 204.

A pnuematic or hydraulic actuator 250, the cylinder of which is slidably supported at the ends thereof by tongue and groove guides 252 (FIG. 12) for bidirectional movement transverse to the rails 230 and the conveyor line 204. The output shaft 254 of the actuator 250 is connected at the end thereof to a bracket 256 attached to the lower surface of the support plate 222. The actuator is conventionally connected by lines, not shown, to a fluid supply 258 carried by support plate 222. An abutment plate 260 projects through a slot in the base plate 220 and is fixedly connected to the outer end of the actuator 250.

A hydraulic or pneumatic actuator 262 is fixedly mounted on the lower surface of the base plate 220. The actuator 262 includes an output shaft 264 having an outer end fixedly connected to the abutment 260. A pair of transversely spaced adjustable stops 266, 267 are fixedly mounted on the lower surface of the base plate 220 adjacent the slot and prescribe controlled transverse movement of the actuator 250 with respect to the base plate 220. The actuator 262 is connected to the fluid source 258 by lines, not shown. Upon actuation of the actuator 262, the actuator 250 is shifted between the extended position shown in FIG. 11 and the retracted position shown in FIG. 10. Upon actuation of the actuator 250, the support plate 222 is translated with respect to the base plate 220 between the cylinder extended position shown in FIG. 11 and the retracted position, shown in FIG. 10.

The inductor assembly 212 includes a base 270 which is slidably supported on the upper surface of the support plate 222 and constrained for transverse movement by side rails 272 which engage laterally spaced surfaces thereof. A hydraulic or pnuematic actuator 280 includes a cylinder 282 fixedly connected to the base 270. The actuator 280 includes an output shaft 284 the end of which is fixedly connected to an abutment plate 286 attached to the support plate 222. The actuator 280 is fluidly connected to the supply 258 by lines, not shown. The actuator 280 is effective to shift the inductor assembly 212 relative to the support plate 222 between the retracted position shown in FIG. 10 and the extended position shown in FIG. 11.

The inductor assembly 212 further includes an A-shaped vertical frame 290 having diverging legs 291 attached to the base 270 and rotatably supporting a turntable 292 on which four inductor units 294 are supported in evenly circumferentially spaced relationship. The frame 290 is reinforced by inclined struts 296. A cylindrical shaft 300 is fixedly horizontally supported at the upper end of the frame 290 and has an axis parallel to the plates 220 and 222 and transverse to the rails 230 and the conveyor path 204. The turntable 292 includes a cylindrical sleeve 302 which is telescopically received over the shaft and rotatably supported thereon by bearings 304. The turntable 292 is axially secured to the shaft 300 by nut 306. A mounting disc 310 is fixedly connected to the outer end of the sleeve 302 perpendicular to the axis of the shaft 300 and is reinforced thereto by webs 312. The disc 310 includes four cylindrical apertures through which the inductor units 294 extend. Accordingly, the inductor units 294 together with the disc 292 and the sleeve 302 are rotatably supported by the shaft 300.

A control motor 320 is fixedly supported on the frame 290. The motor 320 has an output shaft terminating with a pinion 322 which drivingly engages a gear 324 mounted on the sleeve 302. Selective energization of the motor 320 will accordingly, through the pinion 322 and the gear 324 bidirectionally rotate the turntable 292 with respect to the shaft 300. The inductor units 294 are substantially as described with reference to the proceeding embodiment. Each includes a housing 340 fixedly supported on the disc 310 and a sleeve 342 extending axially therethrough and having the secondary winding 350 of inductive transformer 351 mounted on an inner end thereof and a floating inductor device 360 at the outboard end. The device 360 is biased to an extended position relative to the housing by a compression spring 362. The inductor 360 terminates with an insert 364 including an inductor coil 366 having a conical surface complementary to the associated valve seat of the presented component 202. The carrier 364 includes an aligning nose 368 which enters the valve stem bore 370 to coaxially position the coil 366 with respect to the valve seat. The position of the sleeve 342 with respect to the housing 340 may be selectively locked by locking assemblies 372. Herein, each of the inductor units carries an inductor coil adapted to register with the valve seats of a particular engine design. Rather than having a bank of inductors for simultaneously heating all of the valve seats, each inductor of the present embodiment is sequentially presented to the valve seats during a heating cycle for that component as described below.

The power supply 214 is mounted by a frame assembly 380 on the upper base. The power supply 214 includes a lead assembly 382 terminating with the primary winding 384 of the inductor transformer 351. Primary winding 384 is telescopically receivable with respect to the secondary winding in the aforementioned manner. The primary winding 384 and the secondary winding 350 are relatively removable between the coupled position shown in FIG. 10 and the uncoupled position shown in FIG. 11 under the control of actuator 280. The lead assemblies and windings are of a hollow construction connected in a conventional. manner to the coolant supply 385, supported on plate 222 by lines 386.

Figure 10:
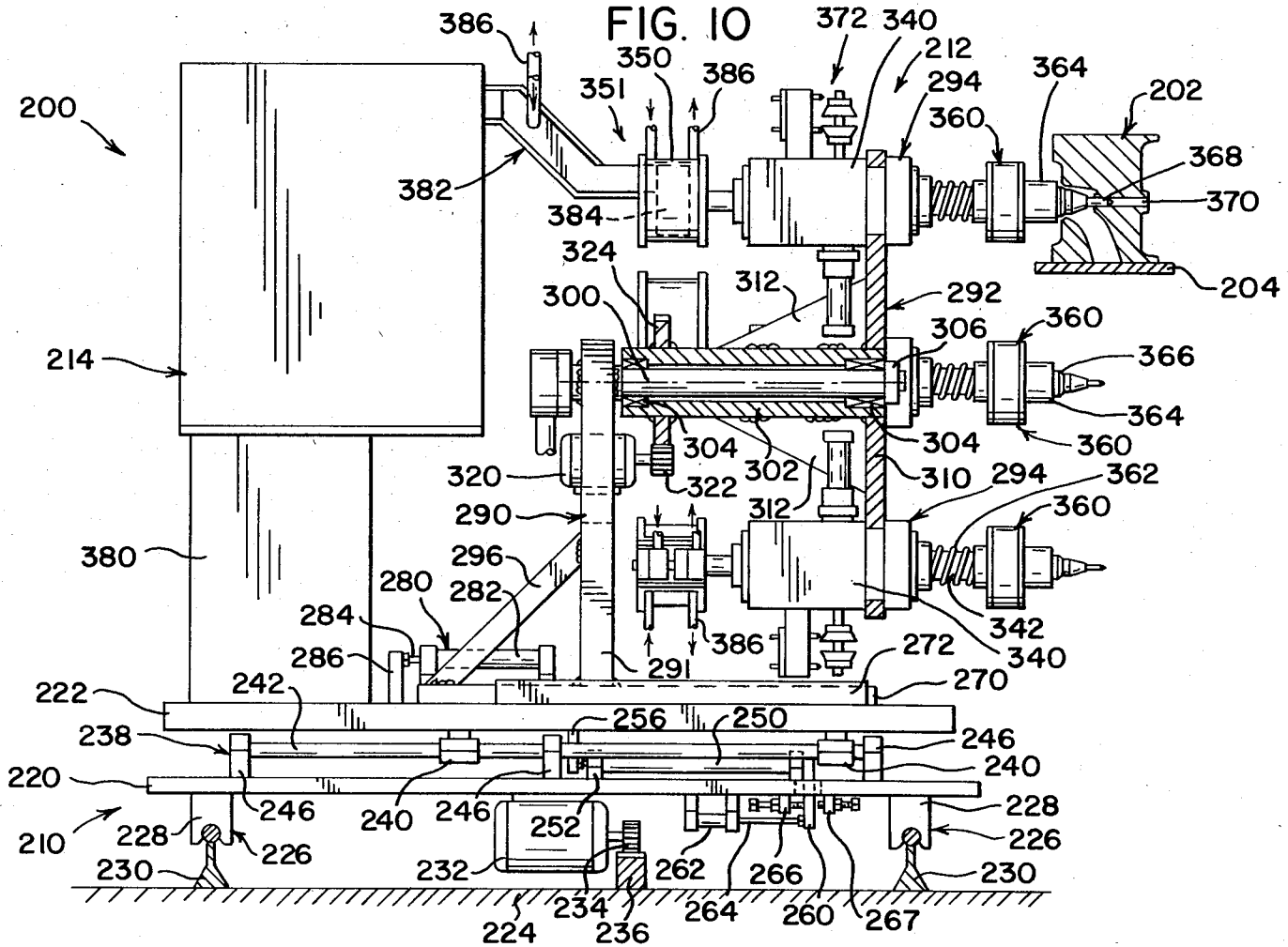
FIG. 10 is a side elevational view of the induction heating apparatus of FIG. 9 showing the inductor assembly in the operative position.
Figure 11:
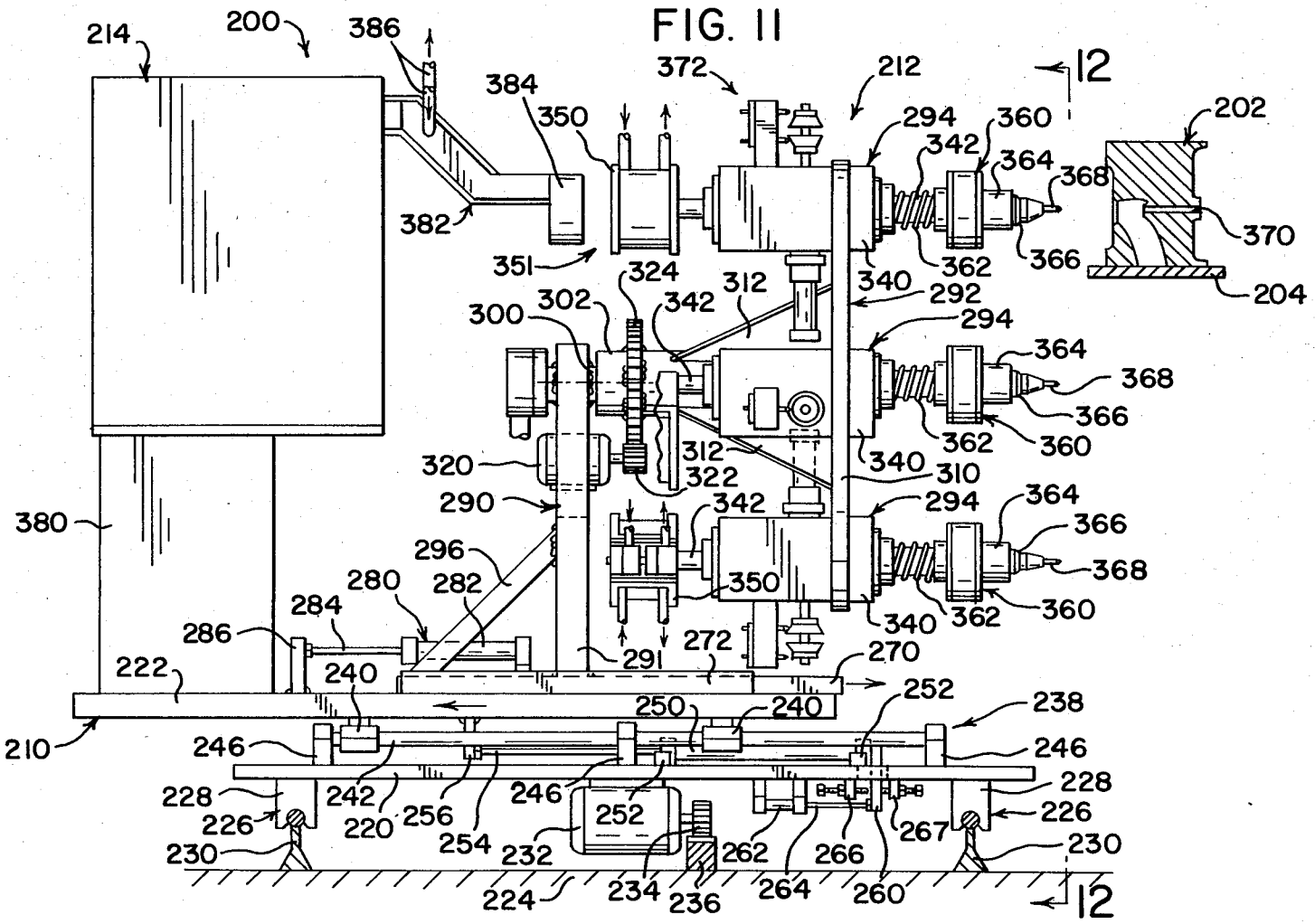
FIG. 11 is a view similar to FIG. 10 showing the inductor heating apparatus in the transfer position.
Figure 12:
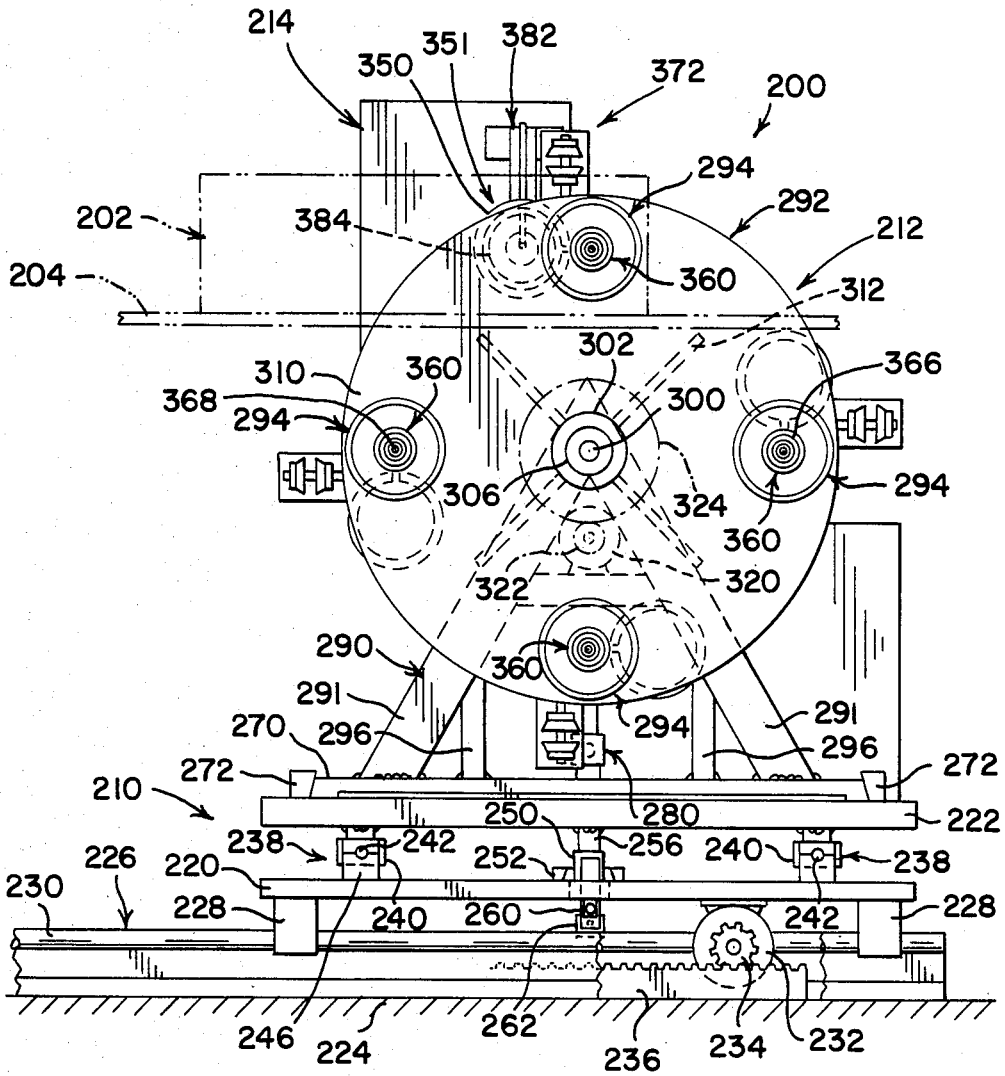
FIG. 12 is a front elevational view of the induction heating apparatus of FIG. 11.

In operation, the conveyor line 204 presents the first valve seat of the presented component 202 at a position aligned with the upper inductor unit 294. Based on the identification of the component by the sensor, the proper inductor unit is presented by rotation of the turntable 292 through energization of the motor 320. The actuator 280 then couples the primary and secondary windings of the transformer 351 as shown in FIG. 10 by rearwardly shifting the inductor assembly relative to the plate 222. Thereafter or in conjunction therewith, the actuator 250 is retracted thereby shifting the plate 222 together with the inductor assembly 212 toward the component. As centering nose 368 of the insert 364 enters the valve stem bore 370, the inductor coil 366 is radially aligned coaxially with the valve seat and the advancing is continued until the coil is seated thereagainst. To account for axial variation in the location of the valve seat, the extension provided by the actuator 250 is slightly overstated and accordingly further extension is effected by the compressing of a spring 362 and rearward telescoping of the sleeve 342 with respect to the housing 340. At the limit of outward extension, the locking assembly 372 for the operative inductor is actuated thereby fixedly clamping the sleeve and thus the inductor coil with respect to the turntable. Thereafter, the actuator 262 is energized and is operative to shift the plate 260 from the forward stop 267 to the rearward stop 266. This slides the cylinder of actuator 250 and its associated output shaft 254 correspondingly rearwardly thereby rearwardly shifting the support plate 222 and the inductor assemblies 212 with the result that the inductor coil 366 is spaced at the predetermined optimum coupling gap with respect to the associated valve seat. Thereafter, the power supply 214 is energized and through the primary transformer 351 and associated leads energize the inductor coil 366 to inductively heat the valve seat area to the predetermined elevated heat treating temperature, all in accordance with known techniques. Upon completion of the inductive heating, quenching of the heated surface may be provided with supplemental quenching jets associated with the inductor or preferably by mass quenching of the valve seat area through the heat sink effect of the component. In either event, the inductor assemblies 212 are withdrawn by extension of the actuator 250 and extension of the actuator 262. This maintains the coupling of the transformer 351 shifting the inductor unit 294 from the component to the transfer position. Thereafter, the control motor 232 is energized to advance the apparatus along the rails 230 until the inductor 294 registers with the next adjacent valve seat. Thereafter, the aforementioned extension, locking, retracting and heating cycles are repeated. These operations continue until such time as all required valve seats have been heat treated.

In the event the next presented component is of a similar design, the primary transformer is not uncoupled and the motor 232 actuated to return the inductor assembly to a position aligned with the first valve seat of the succeeding component. The sequential heat treating of the surfaces then proceeds as discussed above. However, in the event a differing component is presented, the actuator 280 is extended to uncouple the transformer 351 and the control motor 320 energized to rotate the turntable 292 to present the required inductor 294 in registry with the first valve seat. Thereafter, the coupling of the transformer, the extension of the inductor into seated engagement with the valve seat, the locking of the inductor to the housing, the retracting of the inductor from the valve seat surface to establish the desired spacing and the subsequent inductive heating are carried out as set forth above.

Thus, with the aforementioned apparatus and method, a single inductor at a time may be utilized to sequentially heat the valve seats of a particular component design for providing the desired hardness.

For each of the above described embodiments, it is apparent that the same may take many physical embodiments. Thus, the number of inductors, the sequential positioning of the components and their relative movement with respect to the components may be effected with numerous modifications in construction, operation and control of the apparatus.

Moreover, a single inductor or bank of inductors may be designed to accommodate more than one design. Such inductors, commonly referred to as composite inductors, further increase the flexibility of the system.

It is claimed:

1. An induction heating apparatus for heat treating the valve seats for a plurality of engine component designs comprising: conveyor means for moving the engine component designs along a horizontal conveyor line, said conveyor line including a single predetermined heat treating station; a plurality of inductor means, each of said inductor means corresponding to one of said plurality of engine component designs and including at least one inductor coil for heat treating the valve seats of the corresponding engine component design; first means for selectively locating each of said inductor means at a transfer position adjacent to and spaced from said heat treating station in response to a corresponding engine component design presented at said heat treating station by said conveyor means; second means operable transverse to the conveyor line for selectively moving said inductor means from said transfer position to an operative heat treating position with respect to the valve seats of such corresponding design; and, power supply means selectively connected to said inductor means at the heat treating station for energizing the inductor coil thereof at the heat treating position.

2. The apparatus as recited in claim 1 wherein said power supply means includes a power supply and an inductor transformer having a first winding and a plurality of second windings, said first winding being electrically connected with said power supply and said second windings being electrically connected to the coils of each of said inductor means, and third means for electrically coupling said first winding to the secondary winding of said inductor means at said heat treating station.

3. The apparatus as recited in claim 2 wherein said inductor means are carried on a rotatable member, said rotatable member being selectively rotated by said first means to locate a predetermined inductor means at said heat treating station.

4. The apparatus as recited in claim 3 wherein said rotatable member is rotatable about a vertical axis spaced from and transverse to the conveyor line.

5. The apparatus as recited in claim 3 wherein said rotatable member is rotatable about a horizontal axis transverse to said conveyor line.

6. The apparatus as recited in claim 5 including a plurality of support means, each of said support members carrying inductor means for one of the component designs, said second means being operative to shift said support member adjacent the heat treating station between said transfer position and said operative heating position.

7. The apparatus as recited in claim 6 wherein each of said support means carries a plurality of inductor means having inductor coils in a number, spacing and sizing for simultaneously inductively heating the various valve seats of a particular component design.

8. The apparatus as recited in claim 7 wherein said plurality of inductor means are electrically connected to a common secondary winding.

9. The apparatus as recited in claim 8 wherein said second means are operable to shift only the support means located adjacent said heat treating station.

10. The apparatus as recited in claim 9 wherein said third means is operative to shift only the support member located adjacent said heat treating station to couple and uncouple said first winding and said second winding of said inductor transformer.

11. The apparatus as recited in claim 5 wherein said rotatable member carries a plurality of circumferentially spaced inductor means, each inductor means having a single coil adapted to inductively heat the various valve seats for a particular component design, and further including fourth means for shifting said rotatable member parallel to the conveyor line for sequentially heating said various valve seats.

12. The apparatus as recited in claim 11 wherein said third means are operative to couple said inductor transformer prior to the heating of the first valve seat of the component design and to uncouple said inductor transformer after the heating of the last valve seat for such design.

13. The apparatus as recited in claim 12 including a base member carrying said rotatable member supported for reciprocation along a path parallel to the conveyor line, and motor means for selectively shifting said base member along said path to sequentially locate said single coil in said transfer position at the adjacent valve seat, and said rotatable member is carried between said transfer position and said operative heat treating position.

14. An apparatus for inductively heating a selected workpiece found at a workstation and comprising:

transformer means having a first coupling coil connected to a power supply;

carrier means movable with respect to said transformer means;

a second coupling coil slidably receivable with respect to said first coupling coil and supported by said carrier means;

an inductor electrically connected to said second coupling coil and particularly corresponding to said selected workpiece;

means for locating said carrier means with respect to said transformer means in response to said selected workpiece found at said workstation and with said second coupling coil axially aligned with said first coupling coil;

means for axially moving said second coupling coil with respect to said first coupling coil between a first position wherein said coupling coils are axially spaced and a second position wherein an electrical coupling is established therebetween;

means for cojointly moving said first coupling coil and said second coupling coil along a predetermined path to a heating position with said inductor in heating relationship with said selected workpiece;

means for energizing said transformer means with the power supply when said inductor is in said heating position to thereby energize said inductor through said electrical coupling and thereby inductively heat the workpiece.

15. A heat treating unit for inductor hardening the valve seat of a plurality of engine component designs successively located at a heat treating station comprising:

support means;

first actuator means for moving said support means between a first position remote from said heat treating station and a second position adjacent said heat treating station;

carrier means rotatably supported on said support means for rotation about an axis;

a plurality of inductor means supported on said carrier means and circumferentially spaced about said axis, each of said inductor means corresponding to one of said engine component designs;

second actuator means for rotating said carrier means about said axis in response to the engine component design located at said workstation, and to locate a corresponding one of said inductor means adjacent said workstation;

third actuator means independently operatively connected between said carrier means and each of said inductor means for independently moving said corresponding one of said inductor means at said second position of said supporting means between a first position spaced from said valve seat of said engine component and a second position in heat treating relationship therewith; and power supply means for energizing the inductor means located in the heat treating relationship with the valve seat to inductively heat said valve seat to a predetermined elevated temperature.

16. A method of inductively heating at a single heat treating station the valve seats of a plurality of engine component designs traveling along a conveyor path, comprising the steps of:

(a) identifying in advance of said heat treating station the design for a discrete engine component traversing the conveyor path;

(b) providing a plurality of inductor means including a proper inductor means adapted for inductively heating each design of said plurality of engine component designs;

(c) selecting in response to the identifying of step (a) said proper inductor means;

(d) moving said proper inductor means into heat treating relationship with said discrete engine component at said heat treating station: and, (e) inductively heating said discrete engine component with said proper inductor means at said heat treating station.

17. The method as recited in claim 16 including the steps of providing a rotatable carrier supporting said plurality of inductor means and selectively rotating said carrier to locate said proper inductor means adjacent said discrete engine component.

18. The method as recited in claim 17 including the step of providing a plurality of inductor coils in each of said inductor means for heating all of the valve seats on each engine component design and simultaneously moving all of said inductor coils into heat treating relationship at said heat treating station with all of the valve seats of said discrete engine component.

19. The method as recited in claim 17 including the step of providing each inductor means with a single inductor coil adapted to heat all the valve seats of a particular engine component design and sequentially moving said inductor coil of said proper inductor means to each of the valve seats of said discrete engine component and individually inductively heating the valve seat to said elevated temperature.

* * * * *